United States Patent [19]

Bareiss

[11] Patent Number: 4,809,468

[45] Date of Patent: Mar. 7, 1989

[54] LIGHT TRANSMITTER INTERCONNECTING A SKYLIGHT AND A CEILING OPENING

[76] Inventor: Raymond E. Bareiss, 234 Black Horse Pike, Glendora, N.J. 08029

[21] Appl. No.: 42,018

[22] Filed: Apr. 24, 1987

[51] Int. Cl.[4] ..... E04B 7/00

[52] U.S. Cl. ..... 52/22; 52/205; 52/90; 362/147; 362/365

[58] Field of Search ..... 362/147–150, 362/282, 364, 365, 367; 52/27, 107, 199–201, 205, 206, 22, 28; 126/439; 350/258–265

[56] References Cited

U.S. PATENT DOCUMENTS

| | | | |
|---|---|---|---|
| 668,404 | 2/1901 | Hameborg | 350/264 |
| 3,012,375 | 12/1961 | Wasserman | 52/22 |
| 3,710,520 | 1/1973 | Federowicz | 52/27 |
| 4,339,900 | 7/1982 | Freeman | 52/200 |
| 4,365,449 | 12/1982 | Liautaud | 52/28 |
| 4,453,562 | 6/1984 | Palkovics | 137/382 |
| 4,576,440 | 3/1986 | Worthington | 350/258 |
| 4,635,172 | 1/1987 | Steinke | 362/276 |
| 4,733,505 | 3/1988 | Van Dame | 52/22 |

FOREIGN PATENT DOCUMENTS

| | | | |
|---|---|---|---|
| 1346039 | 12/1963 | France | 52/200 |

*Primary Examiner*—John E. Murtagh
*Assistant Examiner*—Andrew Joseph Rudy
*Attorney, Agent, or Firm*—William Freedman; Morton C. Jacobs

[57] ABSTRACT

For connection in a building between a roof containing a skylight opening and a ceiling spaced from the roof and containing a ceiling opening, a light transmitter is provided. This light transmitter includes a base-frame unit for attachment to the ceiling at the ceiling opening and a light-emitting opening extending through the base-frame unit. The light transmitter also includes: (a) a light duct comprising a tubular member formed from a sheet of flexible material rolled up into a tubular form, and (b) means for attaching the tubular member to the base-frame unit at one end and to the roof at its other end, with the tubular member surrounding a reference line extending between the skylight opening and the light-emitting opening.

15 Claims, 6 Drawing Sheets

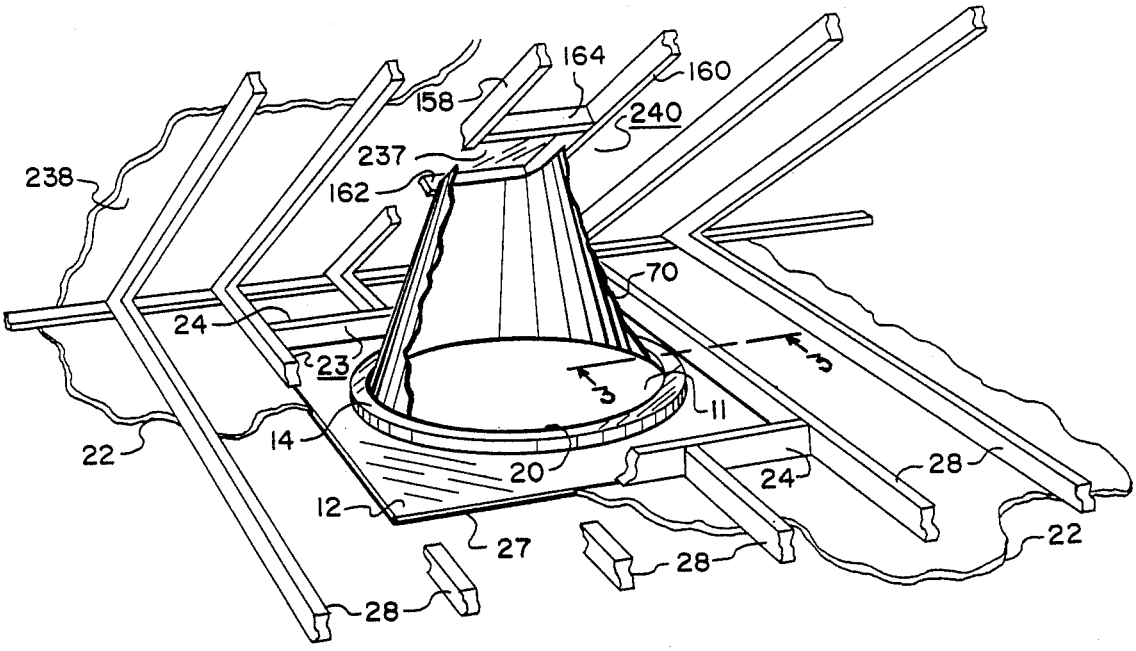
Fig. 4.
Fig. 5.
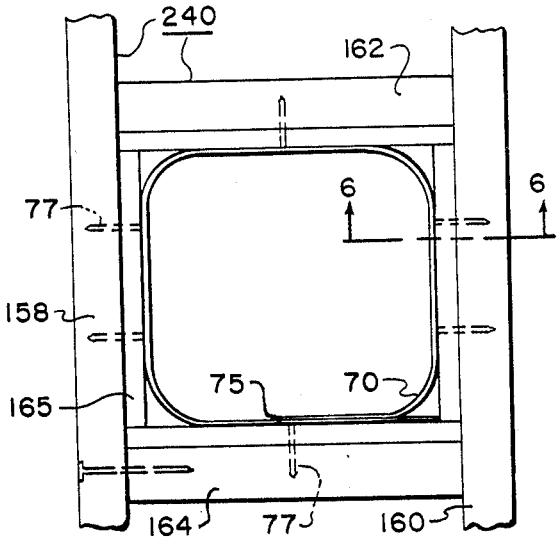
Fig. 6.
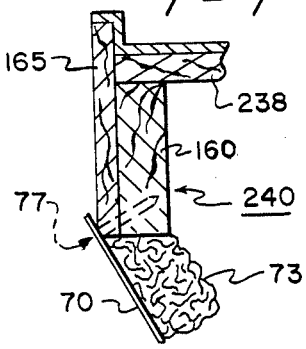

LIGHT TRANSMITTER INTERCONNECTING A SKYLIGHT AND A CEILING OPENING

BACKGROUND

This invention relates to a simple and inexpensive light transmitter for transmitting natural light between a skylight located in or near the roof of a house and an opening in or near the ceiling of a room within the house. The invention also relates to a method for making and installing such a light transmitter.

The usual approach to providing for such light transmission is to carefully construct with wooden studs and plaster board a light shaft that interconnects the skylight and the ceiling opening. More specifically, a carpenter carefully locates, fits, and fastens the studs, cut to precise length and shape, between the roof and the ceiling, positioning the studs so as to form a box-like framework extending between the skylight and ceiling opening. Then sheets of plaster board or the like, carefully cut to appropriate size, are fastened to the inside of the framework to provide a smooth imperforate surface, following which such surface is suitably finished, as by plastering and/or painting.

Planning and building such a light shaft is quite time-consuming and requires considerable carpentry skill.

OBJECTS

An object of my invention is to provide an inexpensive kit which can be easily assembled and installed to provide a light transmitter between a skylight and a ceiling opening.

Another object is to provide a kit having the capabilities of the immediately-preceding paragraph and also readily adaptable to installation with roofs of different slopes and to installations where different amounts of spacing are present between the roof and the ceiling.

Another object is to provide an easily assembled ligiht-transmitter that can be installed between a skylight and a ceiling opening without need for constructing the above-described framework.

Another object is to provide an easily-assembled light-transmitter that readily lends itself to use in a variety of installations, e.g., installations having different ceiling-to-roof spacings, different size skylights, and different amounts of offset between the skylight opening and the ceiling opening.

Another object is to provide a method of constructing and installing a light transmitter of this type which employs inexpensive parts and can be quickly performed without great carpentry skill.

BRIEF DESCRIPTION OF DRAWINGS

For a better understanding of the invention, reference may be had to the following description taken in conjunction with the accompanying drawings, wherein:

FIG. 4 is a perspective view, with portions broken away, of the light transmitter installed between a skylight and a ceiling opening.

FIG. 5 is an enlarged sectional view taken from a plane parallel to the roof, located just beneath the roof, and looking down at the light duct of FIG. 4.

FIG. 6 is a sectional view along the line 6—6 of of FIG. 5.

SUMMARY

In carrying out my invention in one form, I provide a light transmitter for connection in a building between a roof containing a skylight opening and a ceiling spaced from the roof and containing a ceiling opening. The light transmitter comprises: (a) a base frame unit for attachment to the ceiling at the ceiling opening and containing a ligt-emitting opening therethrough, (b) a light duct comprising a tubular member formed from a sheet of flexible material rolled up into a tubular form, and (c) means for attaching the tubular member to the base frame unit at one end of the duct and for attaching the tubular member to the roof at the other end of the duct. The tubular member surrounds a reference line extending between the skylight opening and the light-emitting opening.

In one embodiment of the invention, the tubular member has generally the form of a truncated cone having its base located at the base-frame unit and its opposite end located near the skylight opening.

DETAILED DESCRIPTION OF PREFERRED EMBODIMENTS

Figure 1:
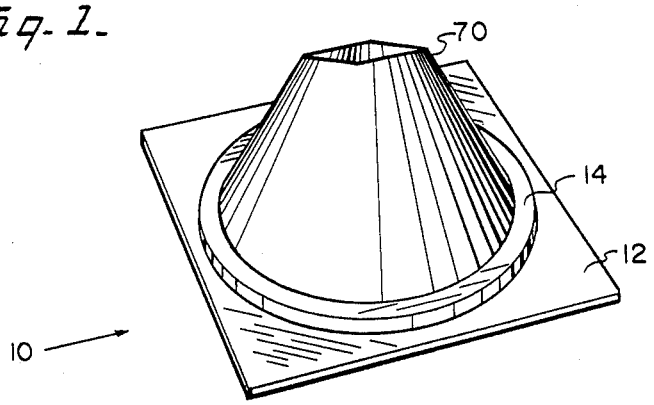
FIG. 1 is a perspective view of a light transmitter embodying one form of my invention.
Figure 2:
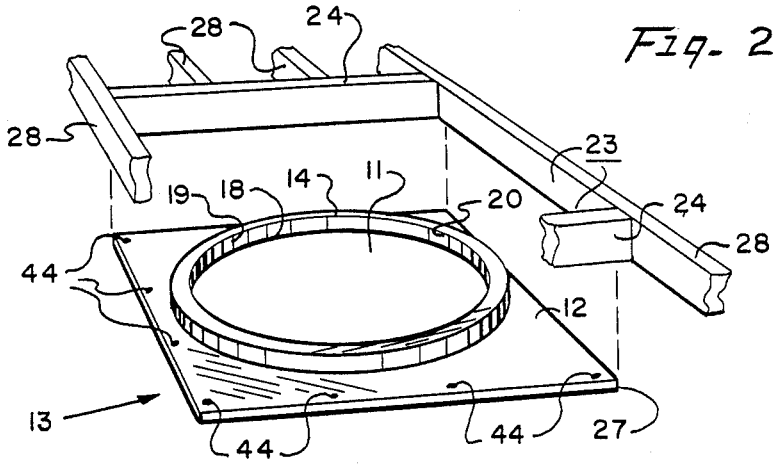
FIG. 2 is an exploded perspective view, with portions broken away, showing how the base frame unit of the light transmitter is attached to the ceiling of a room.
Figure 3:
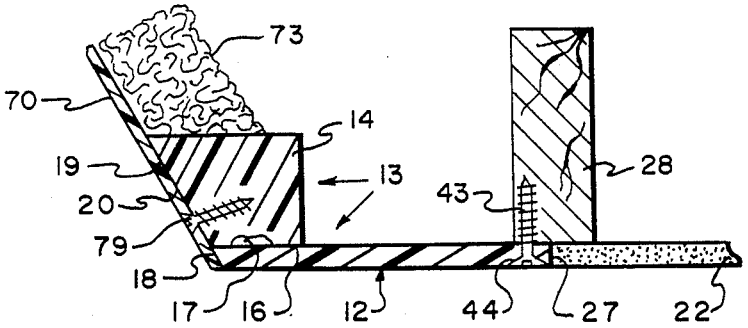
FIG. 3 is a sectional view along the line 3—3 of FIG. 4.

Referring now to FIG. 1, the light transmitter is designated by general reference numeral 10. The transmitter, as shown in FIGS. 1, 2, 3 and 4, includes a square ceiling base-frame 12 of plate form having a large centrally-located opening 11 extending therethrough and a circular mounting ring 14 registering with the central opening 11. In one embodiment, as shown in FIG. 3, the ring 14 is glued along its annular lower surface 16 by suitable bonding material 17 to the top of the square base frame 12 to form an integral frame unit designated by the general reference numeral 13 of FIG. 2. As best shown in FIGS. 2, 3 and 4, the inner surface 18 of base frame 12 and the inner surface 19 of mounting ring 14 form a circular opening 20 in the base frame unit, referred to hereinafter as a light-emitting opening. Although the illustrated base-frame unit 13 is constructed of two parts joined together, it is to be understood that it can alternatively be made from a single piece, as by suitably molding the entire base-frame unit in one piece. A suitable material for this purpose is polyethylene or polystyrene.

Referring to FIG. 4, to prepare the ceiling of a room for installation of the base frame unit 13, certain of the joists 28 in the ceiling are cut, and reinforcing headers 24 are nailed in place across the free ends of the cut joists and between intact joists. This provides a square framework 23 defined by joists and headers, the size of which is made slightly smaller than the square base frame 12. Next, a square section of the plaster or plaster board portion 22 of the ceiling aligned with the square framework 23 is cut out and removed. The space made available by this removed ceiling section is made slightly larger than the square base frame 12.

Alternatively, the ceiling plaster board may be cut first and a section removed, following which the joists are cut and the headers installed.

After this preparation has been completed, the square base frame 12 is inserted into the space made available by the removed plaster so that the bottom surface of base frame 12 is approximately flush with the bottom of the adjacent ceiling. Following this, the base frame 12 is fastened to the above-described framework 23 by screws 43 (FIG. 3) inserted from below through predrilled holes 44 in the base frame portion surrounding light-emitting opening 20.

Referring to FIG. 4, a skylight 237 is shown in the roof 238 of the house. This skylight, which may be of any suitable commercially-available type, is installed in the roof in a conventional manner. Just beneath the skylight 237 is a square roof framework 240 formed from two existing adjacent rafters 158 and 160 and spaced headers 162 and 164 extending transversely of these rafters and nailed between them. Also forming a part of this framework, as seen in FIG. 6, is a liner box 165 that provides a lining for the framework and projects a short distance above the roof. Other details of the skylight installation are not shown since these are not material to the present invention.

For transmitting light from the skylight to the ceiling opening, I provide a light-transmitting duct 70 of truncated generally conical form. This duct 70 is formed from a rolled-up sheet of flexible material, which may be of a suitable plastic, such as polyethylene, polypropylene, or polystyrene, or of a suitable paper. The sheet should have a width greater than the distance between the ceiling base-frame 12 and the roof framework 240. If made of one of the above plastics, a preferred thickness for the sheet material is between 0.010 and 0.040 inches.

A preferred method for forming the duct is as follows. First, the above-described sheet is rolled into a cylindrical tubular form with the rolled ends of the sheet overlapping, and then this tubular form is inserted from below, first through the light-emitting opening 20 in the ceiling base-frame unit 13 and then through the roof opening that is normally occupied by the skylight, as best seen in FIG. 4. (The skylight itself is then not yet in place). Then the tubular form, being slightly resilient, is allowed to expand until it generally fills the opening in the roof framework 240. Thereafter, the installer expands the diameter of the portion of the tubular form located in the light-emitting opening 20 at the ceiling. He does this by partially unwinding, or decreasing the overlap of, the sheet in this ceiling region, in effect converting the cylindrical tubular form into a truncated conical form. When this has been done, the truncated conical form generally fills both the light-emitting opening 20 and the opening in the roof framework 240.

The installer then tacks the two portions of the truncated conical form that are located in the two openings to the respective frame units surrounding the openings. The portion of the conical form in lower opening 20 will remain round since opening 20 is round, but the portion in the upper opening (best seen in FIG. 5) will become generally square since the surrounding roof framework 240 has a square opening therethrough. In the upper opening, tacking is omitted in the corners of the square framework, thus allowing the duct form to have rounded corners, as best seen in FIG. 5.

With the tubular form thus located and secured, the installer trims both the top and bottom ends of the form, thus providing smooth non-projecting ends. The upper end is trimmed so that it terminates at a desired location within the liner box 165 of the roof framework (as shown in FIG. 6), and the lower end is trimmed so that it terminates at or just above the bottom surface of the base frame 12 (as shown in FIG. 3) Such trimming is effected by the installer, preferably, with a sharp razor-type knife while standing on a step ladder with his upper body portion located within the duct 70. Alternatively, the upper edge could be trimmed by the installer while positioned outside the house on the roof.

After the above-described installation steps, the installer will apply adhesive to overlapping portions of the tubular form located in areas not visible from inside the duct, thereby strengthening and more permanently shaping the tubular form 70 when the adhesive sets and cures. He will also install more permanent fastening means, such as the screws 77 of Figs. 5 and 6 and the screws 79 of FIG. 3, for securing the duct 70 to its surrounding supporting frames. When the tubular duct is so located, it surrounds a reference line extending between the centers of the skylight opening and the light-emitting opening 20.

In some cases, instead of applying adhesive or in addition to applying adhesive as above described, the installer will apply a suitable tape to either or both of the joints in the duct 70.

Thereafter, the installer will apply thermal insulation (such as shown at 73 in FIGS. 3 and 6) to the outer surface of the duct 70. A preferred way of doing this is to apply urethane foam insulation to the outer surface of the duct. This can be performed in the attic space by spraying the foam insulation from an aerosol container onto the outer surface of the duct.

Another way of applying insulation is simply by wrapping the outer surface of the duct with fiberglass insulation taken from a roll.

The installer finishes the inner surface of the duct by applying a suitable joint compound to the longitudinal inner seam 75 (FIG. 5), to the extreme lower end of the duct, and to the screw head locations, after which he paints the inner surface. As further finishing, the narrow space between the outer periphery 27 of the ceiling base frame 12 and the surrounding plaster portion of ceiling 22 is filled with a suitable compound, and the lower surface of the base frame together with this compound is suitably painted.

It should be understood that the roof opening can be of shapes other than square. For example, the headers 162 and 164 can be located further apart than shown, or rafters may be cut to provide for a greater dimension transversely of the rafters. In general, the size of this opening will correspond to the size of the skylight used.

Figure 7:
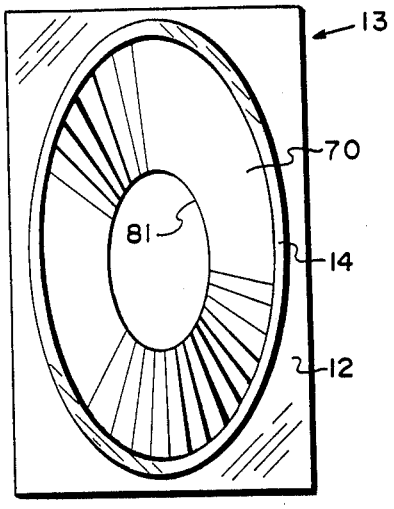
FIGS. 7, 8, and 9 are sectional views illustrating different embodiments of the invention. These views are taken along a plane at the top of the light duct extending through the light duct transversely of its axis and showing different configurations of the base of the light duct.
Figure 8:
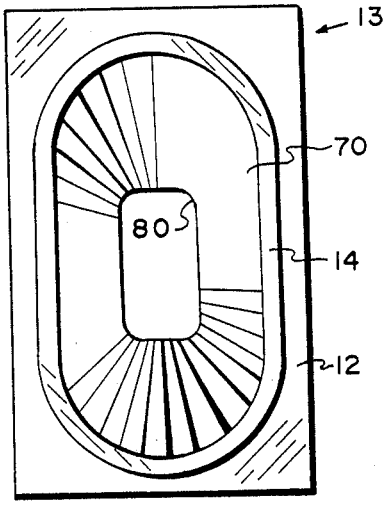

It is to be noted that the light-emitting opening 20 in the ceiling base-frame unit may be of various different shapes, instead of the round shape illustrated in FIGS. 1–4. For example, the opening may be of an oval form, as shown in FIG. 7, or it may be of a generally rectangular form with rounded ends, as shown in FIG. 8, or it may be of the tear-drop form of FIG. 9. In each of these cases, the duct 70 is installed in essentially the same manner as above described, with care being taken by the installer in each case to conform the lower portion of the tubular duct as closely as possible in cross-section to the cross-section of the surrounding opening in the base frame unit 13. The upper opening 80 in these examples is shown as being of a non-square rectangular shape.

It is noted with respect to the upper end of the duct 70 in each of the embodiments that the duct, being of rectangular cross-section in this region, closely conforms to the shape of the opening in the surrounding framework 240. Since the opening in the surrounding framework 240 is of essentially the same size as the opening in the skylight, substantially all of the light entering through the skylight enters the duct. The duct is an excellent light transmitter because of its generally conical form. The smooth rounded inner surface of the duct enhances its light-transmitting properties. Although the extreme upper end of the illustrated duct has a more rectangular cross-section, this rectangular cross-section extends for only a short distance along the duct axis, soon merging smoothly into the more rounded, or curvilinear, cross-sectional form of the lower portion of the tubular duct. Thus, the duct is of cirvilinear cross-section form along most of its length.

In FIGS. 1–6, the skylight is illustrated as being located directly over the ceiling opening. My invention is also applicable to arrangements where the skylight is laterally offset from the ceiling opening. In such applications, the base frame unit 13 and the tubular duct 70 are installed in essentially the same manner as described hereinabove.

Figure 9:
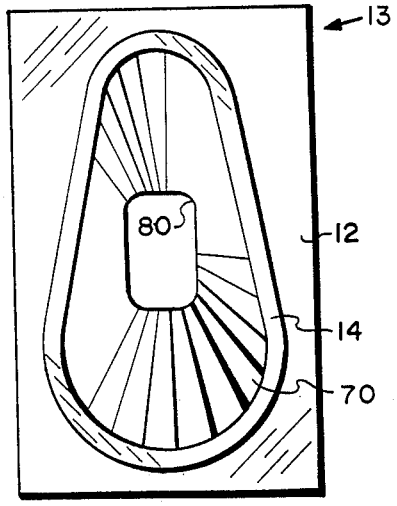

In one form of my invention, the base frame unit 13 and the sheet from which duct 70 is fabricated are offered for sale in unassembled kit form. The purchaser can use this kit to make and install a light transmitter suitable for a wide variety of roof-to-ceiling spacings and for many different roof opening sizes. These different dimensions are accommodated as set forth in the above description of my method of making and installing. The duct-forming sheet can be rolled into tubular forms of various diameters to accommodate different size openings and can be trimmed at the ends of the tubular form to accommodate different roof-to-ceiling spacings or different slopes of the axis of the tubular form. The axis of tubular form can be slanted as desired to accommodate different degrees of offset between the roof opening and ceiling opening. Different sizes and shapes for the light-emitting opening, as illustrated in FIGS. 7, 8 and 9 can be provided to satisfy individual customer preferences and/or needs.

Although each of the light-transmitting ducts 70 in the above-described embodiments has been described as being formed from a single sheet of flexible material rolled into a tubular form, my invention in its broader aspects comprehends making the duct from a plurality of segments (not shown) of flexible sheet material, each extending over the length of the tubular form and defining a portion of the circumference of the tubular form. Each of these segments is fastened in place at its opposite ends, with one end being fastened to the mounting ring 14 at the ceiling and the other end to the roof framework 240. The circumferentially-adjacent segments overlap, forming seams that run along the length of the duct. These seams are covered with a suitable joint compound during finishing.

Figure 9A:
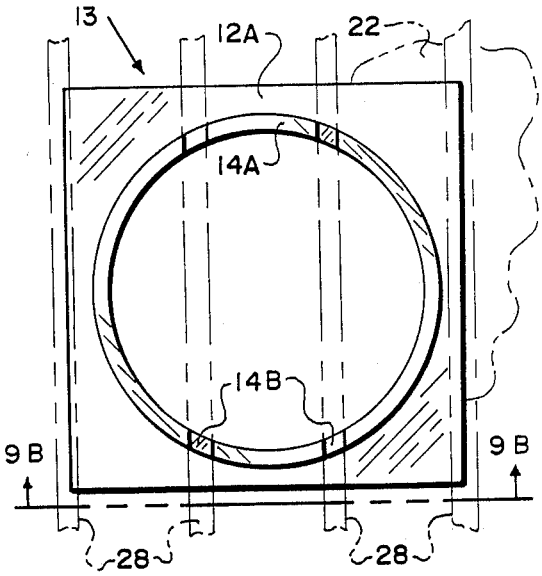
FIG. 9A is a plan view showing a modified form of base frame unit attached to a ceiling. This view is taken from a plane located just above the ceiling joists, which in this modification are left uncut.

In the above-described embodiments illustrated in FIGS. 1–9, the ceiling joists 28 are cut, and transverse headers 24 are installed across the cut ends to form a frame-work 23 to receive the base frame unit 13. In a modified embodiment of the invention illustrated in FIGS. 9A and 9B, the ceiling joists are left intact and a modified base frame unit 13A is used. This modified base frame unit comprises a mounting ring 14A corresponding to the mounting ring 14 of base frame unit 13 but provided with spaced slots 14B for receiving the uncut joists 28 that extend thereacross. The base frame 12A is fastened to the lower side of the joists in the same manner as in the embodiment of FIGS. 1–6, fitting into an opening cut in the plaster board 22 of the ceiling.

Figure 9B:
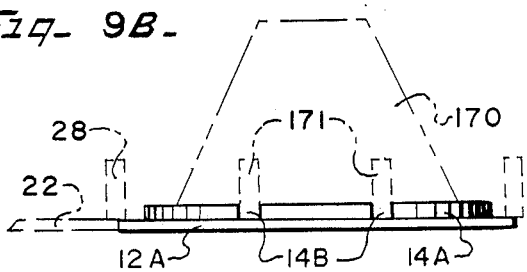
FIG. 9B is a sectional view along the line 9B—9B of FIG. 9A.

The light-transmitting duct 170 of FIG. 9B is the same as the duct 70 of FIGS. 1–6 except that slots 171 are cut in the lower end of the duct 170 to receive the ceiling joists 28 extending across the lower end of the duct 170. During installations, the tubular form from which duct 170 is fabricated is preferably inserted through the roof opening instead of from the room below, thus reducing interference from the joists 28 across the lower end of duct 170. After the duct 170 has been properly shaped and fitted into place in both the roof opening and the light-emitting opening 20, it is fastened in each of these openings and finished in the same manner as described hereinable with reference to the embodiment of FIGS. 1–6.

Figure 10:
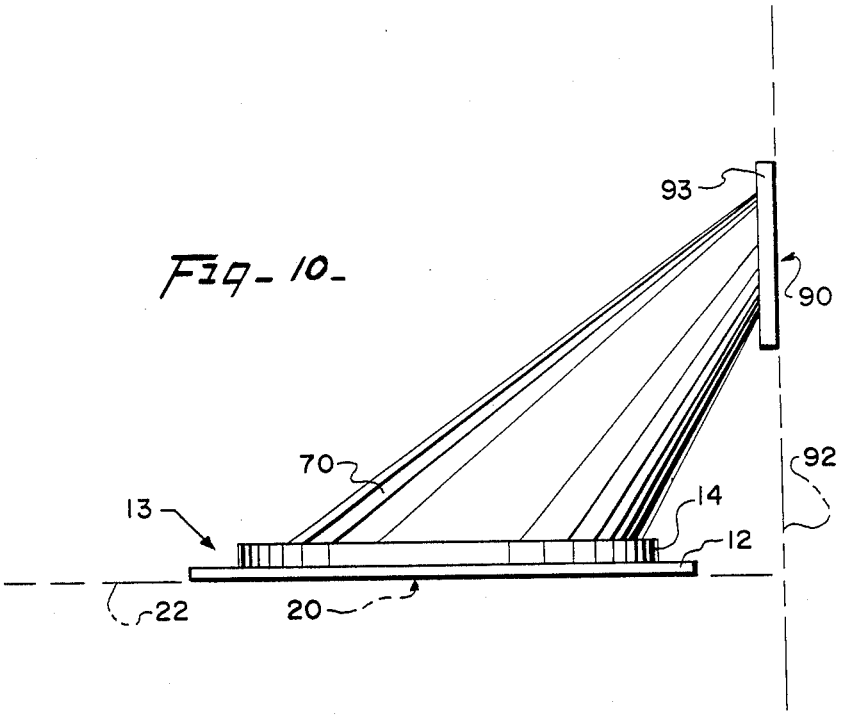
FIG. 10 is a simplified side elevational view of another embodiment of my invention; specifically one in which the skylight, in the form of a window, is located in a roof-end gable.
Figure 11:
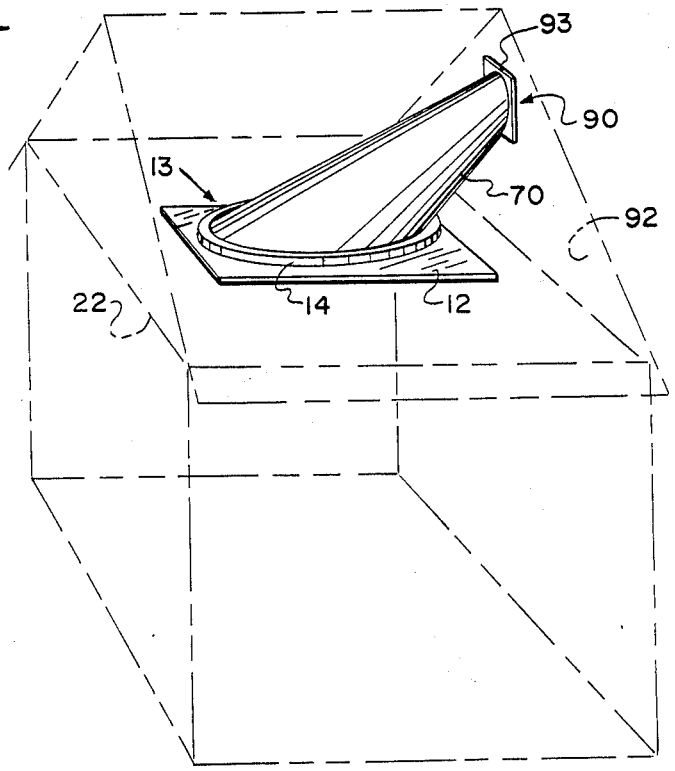
FIG. 11 is a perspective view of the light transmitter of FIG. 10, with pertinent portions of the associated house being shown in phantom.

FIGS. 10 and 11 show my invention applied to an installation where a skylight opening 90, instead of being in the roof of the house, is located near the roof in an endgable 92 and takes the form of a window. The tubular form 70 that is used in this modification is of truncated generally conical configuration and extends between the light-emitting opening 20 in the ceiling and the end-gable opening to provide a duct that conveys light from the gable opening to the light-emitting opening. The tubular form 70 is installed in essentially the same manner as described in connection with Figs. 1–6. In the illustrated embodiment, the end-gable opening is made round to facilitate installation of the duct. A round framework 93 is aligned with opening 90 to provide a stationary support structure to which the upper end of the light duct 70 is suitably attached. The opening 20 and the surrounding ring 14 in the ceiling base-frame unit 13 are preferably made elliptical in shape to more readily accommodate the generally conical duct 70 with its inclined longitudinal axis.

Figure 12:
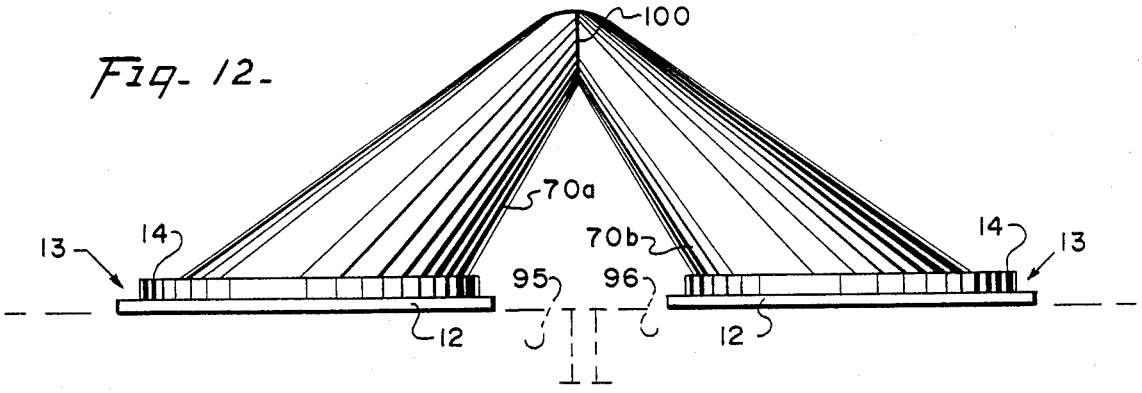
FIG. 12 is a side elevational view of still another embodiment of my invention; specifically one which comprises a single skylight and light transmitters extending therefrom to two separate rooms.
Figure 13:
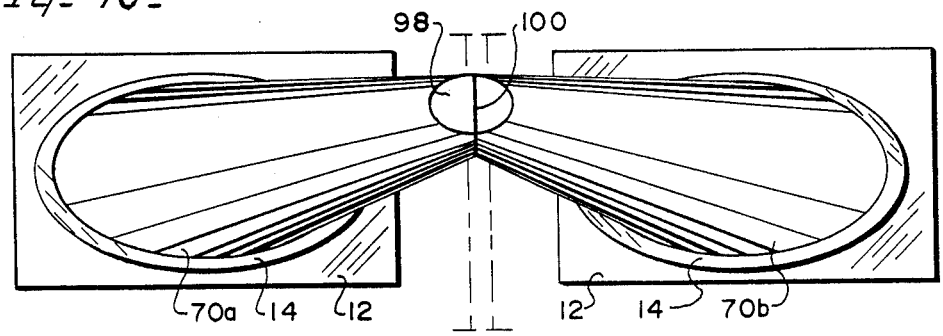
FIG. 13 is a plan view of the embodiment of FIG. 12.
Figure 14:
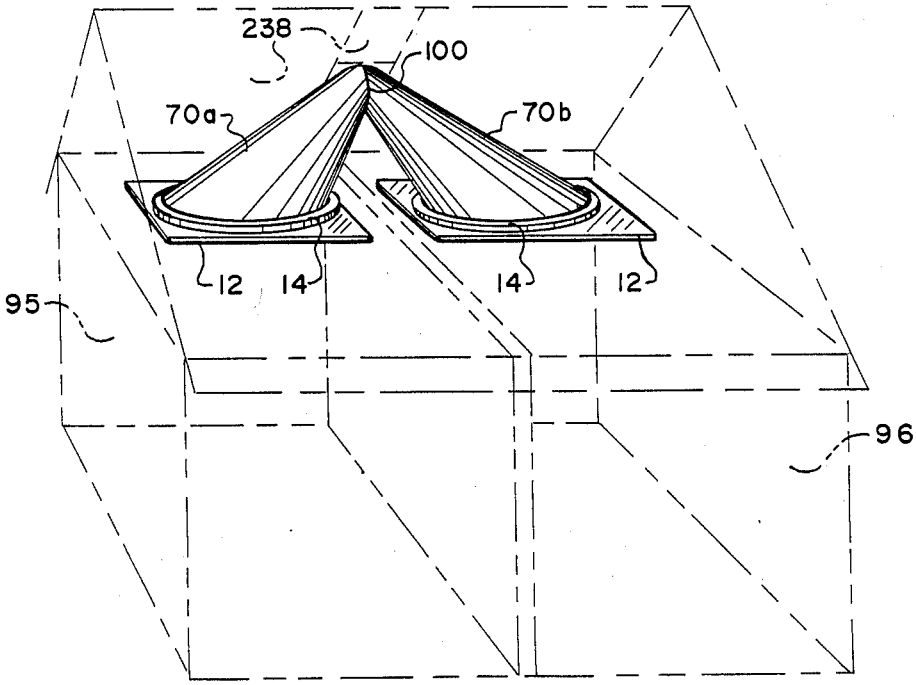
FIG. 14 is a perspective view of the embodiment of FIG. 12, with pertinent portions of the associated house being shown in phantom.

In the embodiment of FIGS. 12–14, an arrangement is shown in which a single skylight opening 98 in roof 238 is used for providing light for two different rooms 95 and 96 of a house. Two light-transmitting ducts 70a and 70b are provided, each extending between its associate room and the single skylight opening. One of these ducts, say 70a, is first installed in the same manner as described in connection with FIGS. 1–5 between room 95 and the skylight opening. Then duct **70*a* is cut near its top to provide an exposed vertical edge at line 100 inside the attic, following which the portion of duct 70*a* to the right of edge 100 is removed and discarded. Then the second duct 70*b* is installed between the other room 96 and the skylight opening, and it is cut near its top to provide a vertical edge at line 100 that registers with the corresponding vertical edge of duct 70*a*. The line 100 marks the location at which the walls of the two tubular forms 70*a* and 70*b* intersect. The two ducts are then attached to each other along their edges at line 100, using duct tape on their outside surfaces to hold these portions together. The openings in the ceiling base-frames 12 are preferably made of an elliptical configuration to more readily accommodate the generally conical ducts 70*a* and 70*b***, which in this case have inclined longitudinal axes.

Figure 15:
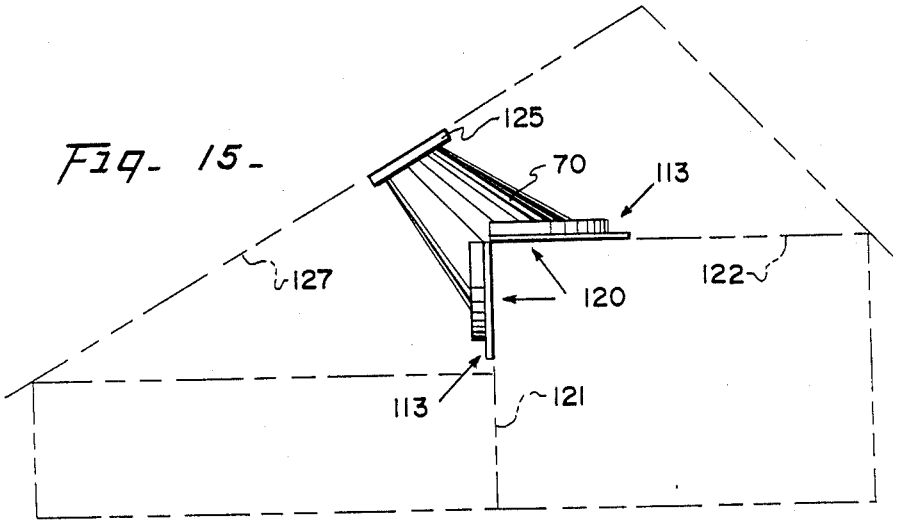
FIG. 15 is a simplified side elevational view illustrating still another embodiment of my invention applied to a split-level house.
Figure 16:
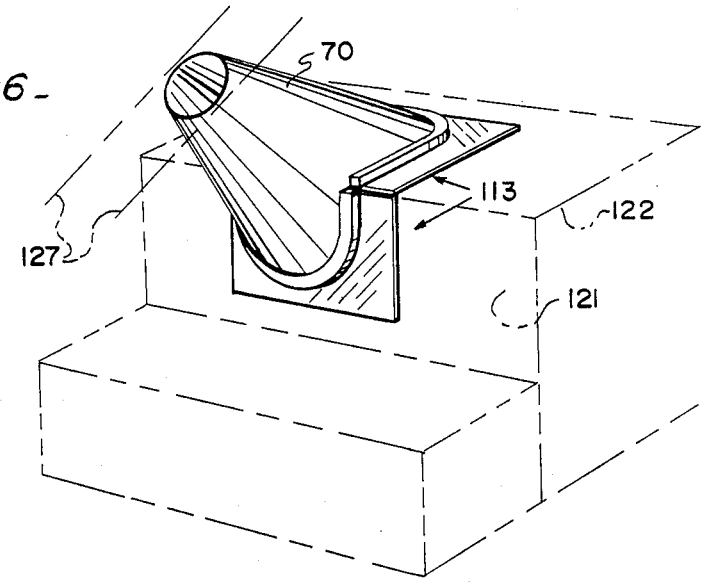
FIG. 16 is a perspective view of the embodiment of FIG. 15.

In the embodiment of FIGS. 15 and 16, the light-emitting opening 120 is shown as being provided in two perpendicular surfaces of the room, one a wall 121 and one the ceiling 122. One half of the base frame unit 113 is located in the wall and the other half in the ceiling. A tubular duct 70 extends between the light-emitting opening 120 and a framework 125 attached to the roof 127 just beneath the skylight. The tubular duct 70 is installed in essentially the same manner as described in connection with FIGS. 1–5.

Figure 17:
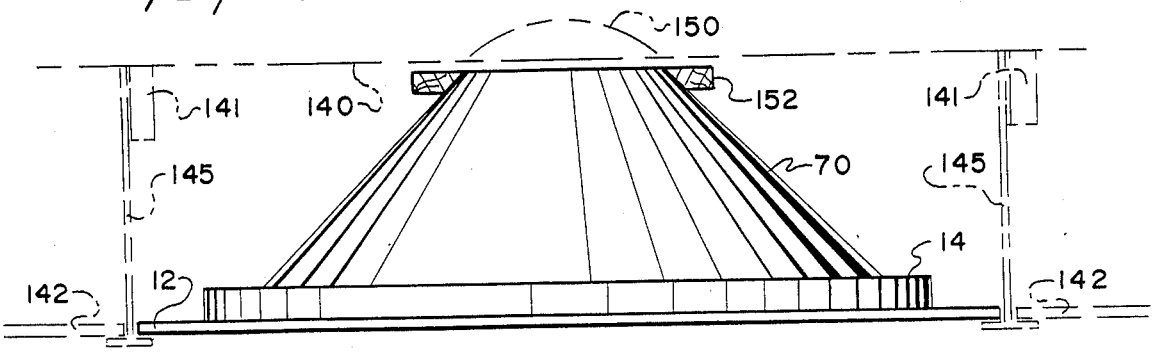
FIG. 17 illustrates still another embodiment of the invention applied to a commercial building, parts of which are shown in phantom.

FIG. 17 shows another form of my invention, applied in this case to an industrial or commercial building. This building has a flat or low-sloped roof 140 supported on beams 141 and a suspended ceiling 142 supported from T-shaped metal frames 145 attached to beams 141. My ceiling base frame 12 is of such a size that it fits between the frames 145 and can be supported on the upper surface of the lower flanges 146 of the frames. Integral with the base frame 12 is an annular mounting ring 14 of circular form. Parts 12, 14 and 70 are similar to correspondingly designated parts in FIGS. 1–5.

A light duct 70 of truncated conical form, either custom fabricated as above-described or prefabricated to be of the proper size, is supported on the base frame 12 and projects upwardly, terminating immediately adjacent the domed skylight 150 in the roof 140. In one embodiment, the upper end of the duct 70 is suitably attached to an annual roof frame 152 located just beneath the skylight 150.

Since there may be many identical installations of the type shown in FIG. 16, prefabricated fasteners and supports (not shown) at both the top and bottom of the light duct 70 may economically be provided to hold the light duct 70 in its illustrated position.

It is noted that the base frame 12 in FIG. 17 is located atop the flanges 146 of the ceiling support frames 145. This is the same position that a ceiling element such as an acoustic panel normally rests. By making the base frame 12 approximately the same size as the acoustic panel, it is possible simply to substitute base frame 12 for the acoustic panel and complete its installation in the ceiling quickly and, if desired, without additional fastening means.

While I have shown and described particular embodiments of my invention, it will be obvious to those skilled in the art that various changes and modifications may be made without departing from my invention in its broader aspects; and I, therefore, intend herein to cover all such changes and modifications as fall within the true spirit and scope of my invention.

What I claim as new and desire to secure by Letters of Patent of the United States is:

1. For connection in a building between a roof containing a skylight opening and a ceiling spaced from the roof and containing a ceiling opening, a light transmitter comprising, in combination, :

a base-frame unit for attachment to said ceiling at said ceiling opening and containing a light-emitting opening there-through of a predetermined cross-sectional shape, a light duct having two ends comprising a tubular member formed from a sheet of flexible material rolled up into a tubular form, the sheet having two ends overlapping by a controlled amount of overlap, and means for attaching said tubular member to said base frame unit at one end of the duct and for attaching said tubular member to said roof at the other end of said duct, with the tubular member having a curvilinear cross-sectional form along most of its length and surrounding a reference line extending between the skylight opening and the light-emitting opening, said tubular member having generally the form of a truncated cone having its base located at the base-frame unit and its opposite end located near the skylight opening, the diameter of the cone at different points along its length being controlled by the amount of said overlap at said different points.

2. The combination of claim 1 in which the opening through said base frame unit is generally circular in cross-section.

3. The combination of claim 1 wherein: (a) said base-frame unit includes a ring surrounding the light-emitting opening in the base-frame unit, and (b) said tubular member extends through the ring and is attached thereto.

4. The combination of claim 1 in which the opening through said base frame unit is generally oval in cross-section.

5. The combination of claim 1 wherein:

said base-frame unit comprises a base frame of plate form and a ring on said base frame, the ring and the base frame having an opening with a smooth periphery therethrough through the ring and the base frame forming said light-emitting opening, said tubular member extends into said light-emitting opening in the ring and base frame, and said base frame of plate form is adapted to be fastened to said ceiling in a region of the base frame surrounding said light-emitting opening.

6. In a building, in combination, a roof, an end gable at the end of the roof having a skylight opening therethrough, a ceiling spaced from said roof and containing a ceiling opening, and a light transmitter comprising:

a base-frame unit comprising a base frame attached to said ceiling at said ceiling opening and containing a light-emitting opening therethrough of a predetermined cross-sectional shape, a light duct having upper and lower ends and comprising a tubular member formed from a sheet of flexible material rolled up into a tubular form, the sheet having two ends overlapping by a controlled amount of overlap, means for attaching said tubular member to said baseframe unit at the lower end of the light duct, and means for attaching said tubular member to said gable at the upper end of said light duct, said tubular member having a curvilinear cross-sectional form along most of its length and surrounding a reference line extending between the skylight opening and the light-emitting opening, said tubular member also having generally the form of a truncated cone having its base located at the base-frame unit and its opposite end located near the skylight opening, the diameter of the cone at different points along its length being controlled by the amount of said overlap at said different points.

7. For connection in a building between a roof containing a skylight opening and a ceiling spaced from the roof, comprising joists, and containing a ceiling opening; a light transmitter comprising, in combination,:

a base-frame unit for attachment to said ceiling at said ceiling opening and containing a light-emitting opening there-through of a predetermined cross-sectional shape, a light duct comprising a tubular member formed from one or more sheets of flexible material, and means for attaching said tubular member to said baseframe unit at one end of the duct and for attaching said tubular member to said roof at the other end of said duct, with the tubular member having a curvilinear cross-sectional form along most of its length and surrounding a reference line extending between the skylight opening and the light-emitting opening, said base-frame unit including a ring surrounding the light-emitting opening in the base-frame unit, and said tubular member extending through the ring and being attached thereto, said ring containing slots for receiving the joists of said ceiling, and said light duct containing slots at said one end also for receiving said joists.

8. In a building, in combination, :

a roof containing a skylight opening, a ceiling spaced from said roof and containing a ceiling opening, and a light transmitter comprising:

a base-frame unit comprising a base frame attached to said ceiling at said ceiling opening and containing a light-emitting opening therethrough of a predetermined cross-sectional shape, a light duct having upper and lower ends and comprising a tubular member formed from a sheet of flexible material rolled up into a tubular form, the sheet having two ends overlapping by a controlled amount of overlap, means for attaching said tubular member to said base-frame unit at the lower end of the light duct, and means for attaching said tubular member to said roof at the upper end of said light duct, said tubular member having a curvilinear cross-sectional form along most of its length and surrounding a reference line extending between the skylight opening and the light-emitting opening, said tubular member also having generally the form of a truncated cone having its base located at the base-frame unit and its opposite end located near the skylight opening, the diameter of the cone at different points along its length being controlled by the amount of said overlap at said different points.

9. The combination of claim 8 in which said building comprises a roof framework surrounding said skylight opening and said attaching means comprises means for fastening said tubular member at its upper end to said roof framework.

10. In a building containing the combination of claim 8, a second ceiling spaced from said roof and containing a second ceiling opening, a second light transmitter comprising:

a second base-frame unit comprising a second base frame attached to said second ceiling at said second ceiling opening and containing a lighte-mitting opening therethrough, a second light duct comprising a second tubular member formed from one or more additional sheets of flexible material and having upper and lower ends, means for attaching said second tubular member to said second base-frame unit at the lower end of the second tubular member, and means for attaching said second tubular member to said roof at the upper end of said second tubular member, and said second tubular member having a curvilinear crosssectional form along most of its length and surrounding a second reference line extending between said skylight opening and said second light-emitting opening.

11. The combination of claim 10 in which: (a) said first and second tubular members define light duct walls and said walls intersect along a line located near said skylight opening, and (b) portions of said walls are removed in the regions above said intersection line.

12. The combination of claim 8 in which:

said base frame unit includes a ring surrounding the light-emitting opening in the base frame unit, and said tubular member extends through the ring and is attached thereto.

13. For connection in a building between a roof containing a skylight opening and a suspension ceiling spaced from the roof and containing a ceiling opening, a light transmitter comprising the combination of:

a base-frame unit for support on said ceiling at said ceiling opening and containing a light-emitting opening there-through of a predetermined cross-sectional shape, a light duct having two ends and comprising a tubular member of truncated conical form formed from one or more sheets of flexible material, said flexible material rolled up into a tubular form, the sheet or sheets having two ends overlapping by a controlled amount of overlap, and means for supporting said tubular member on said base frame unit at one end of the duct and for locating said tubular member adjacent said roof at the other end of said duct, with the tubular member having a curvilinear cross-sectional form and a smooth internal surface along most of its length and surrounding a reference line extending between the skylight opening end and the light-emitting opening.

14. The light transmitter of claim 13 in which said ceiling comprises acoustic panels and a ceiling support framework for said panels and in which said base frame unit comprises a base frame of plate-form that is of approximately the same size as an acoustic panel in said ceiling, before installation of said light transmitter, whereby said base frame can be substituted for said acoustic panel and caused to rest on the same ceiling support framework as said panel in approximately the same location as said panel.

15. In a building, in combination,:

a roof containing a skylight opening, a ceiling spaced from said roof, comprising joists, and containing a ceiling opening, and a light transmitter comprising:

a base-frame unit comprising a base frame attached to said ceiling at said ceiling opening and containing a light-emitting opening therethrough of a predetermined cross-sectional shape, a light duct comprising a tubular member formed from one or more sheets of flexible material and having upper and lower ends, means for attaching said tubular member to said base-frame unit at the lower end of the tubular member, and means for attaching said tubular member to said roof at the upper end of said tubular member, said tubular member having a curvilinear cross-sectional form along most of its length and surrounding a reference line extending between the skylight opening and the light-emitting opening, said base-frame unit including a ring surrounding the light-emitting opening in the base-frame unit, and said tubular member extending through the ring and being attached thereto, said ring containing slots for receiving the joists of said ceiling, and said light duct containing slots at said one end also for receiving said joists.

* * * * *